United States Patent [19]

Person et al.

[11] Patent Number: 4,807,308

[45] Date of Patent: Feb. 28, 1989

[54] PORTABLE STACKING AND NESTING TOILET

[76] Inventors: LuAnn H. Person, 330 W. 55th St., New York, N.Y. 10019; Kenneth A. Roddy, 15322 E. Ritter Cir., Houston, Tex. 77071

[21] Appl. No.: 131,632

[22] Filed: Dec. 11, 1987

[51] Int. Cl.[4] ..... A47K 11/04; A47K 11/06

[52] U.S. Cl. ..... 4/483; 4/484

[58] Field of Search ..... 4/449, 450, 451, 452, 4/453, 458, 476, 483, 484, 479, 461, 474, 475

[56] References Cited

U.S. PATENT DOCUMENTS

| | | | |
|---|---|---|---|
| 1,947,940 | 2/1934 | Isom | 4/483 |
| 2,396,177 | 3/1946 | Hunter | 4/449 |
| 3,118,146 | 1/1964 | Dorey | 4/476 |
| 3,142,847 | 8/1964 | Kurrels | 4/484 |
| 3,381,315 | 5/1968 | Glassberg | 4/484 |
| 3,600,719 | 8/1971 | Karr | 4/476 |

*Primary Examiner*—Henry J. Recla
*Assistant Examiner*—J. C. Jacyna
*Attorney, Agent, or Firm*—Kenneth A. Roddy

[57] ABSTRACT

A portable stacking and nesting toilet comprises a small cup member which will nest inside a larger cup-shaped member, a seat member having a central opening, and a resilient sealing lid. The bottom of each cup has a raised lip which will engage the lip of the other cup and the open top ends of the cups have an annular rim. The seat member has a groove which engages the rim of the larger cup. In the stored position, the smaller cup nests inside the larger one and the bottom of the larger cup fits inside the seat opening. When assembled for use, the smaller cup is inverted with the resilient lid installed on its rim to serve as a non-skid base and the larger cup is installed upright on the inverted smaller one to engage the bottom lips. A watertight bag is placed in the upright larger cup with the open end of the bag folded over its rim. The seat is placed on the rim of the larger cup to secure the top of the bag on the cup rim and the toilet is ready for use. After use, the seat is removed, the bag is disposed of and the members are nested in the stored position. If there is no convenient location for disposing of the used bag, it may be placed inside the smaller cup and sealed with the lid.

18 Claims, 2 Drawing Sheets

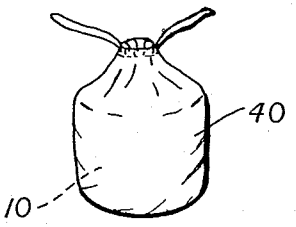
FIG. 5
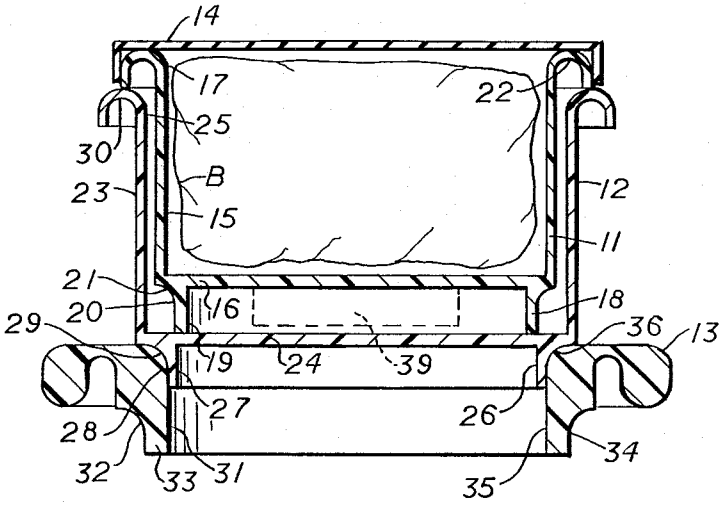
FIG. 2
FIG. 1
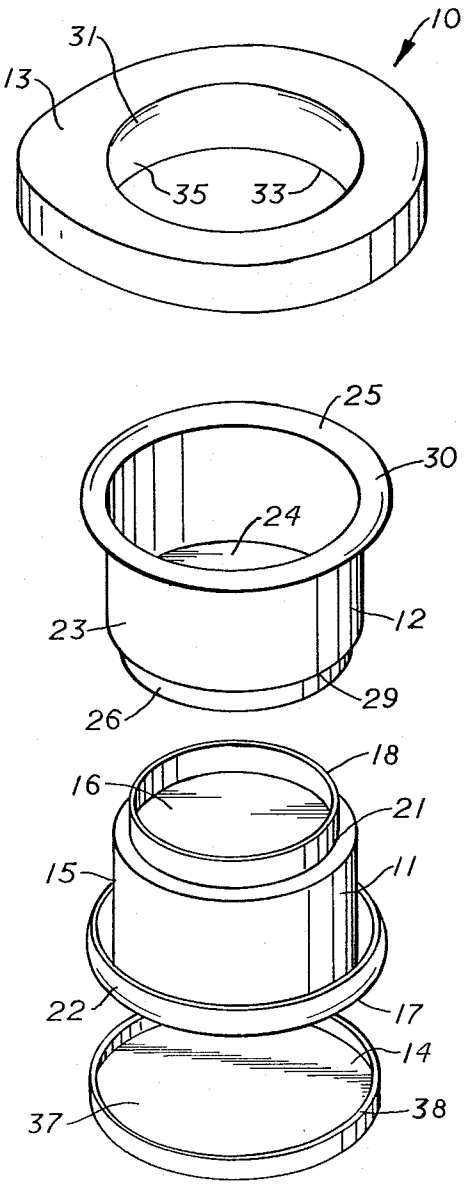

PORTABLE STACKING AND NESTING TOILET

BACKGROUND OF THE INVENTION

1. FIELD OF THE INVENTION

This invention relates generally to portable toilets, and more particularly to a portable stacking and nesting toilet in which the components are compactly nested in the stored position and which are stacked in opposed relation for use.

2. BRIEF DESCRIPTION OF THE PRIOR ART

Portable toilets are known in the art. There are several patents which disclose portable toilets of various construction.

Hennig, U.S. Pat. No. 544,535 and Wagner, et al, U.S. Pat. No. 1,379,374 disclose folding seat structures supported on legs and which have collapsible waste containers.

Weber, U.S. Pat. No. 857,914, Meyer, U.S. Pat. No. 1,223,065, and Moore, U.S. Pat. No. 1,293,509 disclose folding seat structures supported on legs and which have no waste container.

Isom, U.S. Pat. No. 1,947,940 discloses a toilets in a traveling case. A cup-shaped container is housed within a well beneath the seat and has an offset portion to hold the contents when the case is carried.

Brief, U.S. Pat. No. 2,431,538 discloses another toilet in a traveling case. A cup shaped container is supported beneath the seat and extends into a tubular member on the bottom of the case.

La Gorce et al, U.S. Pat. No. 2,801,426 discloses a disposable bag toilet comprising a ring-like frame or rim supported on removable legs and over which a bag is placed. A seat is hinged to the rear of the rim, and the bag is held in place by a resilient gasket on the bottom of the hinged seat.

Karr, U.S. Pat. No. 3,600,719 discloses a collapsible or "knockdown" toilet having a box-like folding structure with a bottom section, body section, and a cover section. The body section may be folded to be received between the bottom and cover sections or folded to be stored within the cover and bottom sections to provide a flat package.

The present invention is distinguished over the prior art in general, and these patents in particular by a portable stacking and nesting toilet comprising a larger and smaller cup-shaped member, a seat member having a central opening, and a resilient sealing lid. The smaller cup will nest inside the larger and the lower portion of the larger cup fits inside the opening of the seat member in an upright stored position. The bottom of each cup has a circular lip which will engage the lip of the other member. The open top ends of the cup members are provided with a rounded rim. The seat member has a groove which engages the rim of the larger cup. When assembled for use, the smaller cup is removed from the larger and inverted with the resilient lid installed on the rim of the smaller cup. The larger cup is installed upright on the inverted smaller one to engage the opposed lips. The resilient lid serves as a non-skid base for the assembled structure. A watertight sealable plastic bag is placed in the upright larger cup and the open end of the bag folded over its rim. The seat is placed on the rim of the larger cup to secure the top of the bag between the cup rim and seat groove and the toilet is ready for use.

After use, the seat is removed and the bag is disposed of. The seat is placed horizontally, the larger cup is removed from the smaller one and placed inside the seat opening, the smaller cup is placed upright inside the larger one, and the resilient lid is placed on the rim of the smaller cup. If there is no convenient location for disposing of the bag, it may be placed inside the smaller cup and sealed with the lid.

SUMMARY OF THE INVENTION

It is therefore an object of the present invention to provide a light weight nesting and stacking and nesting portable toilet which is carried in a compact nested condition to occupy a minimum of space.

It is another object of this invention to provide a portable stacking and nesting toilet which employs a disposable bag, and the components of which may be easily cleaned.

Another object of this invention is to provide a portable stacking and nesting toilet which may be assembled and disassembled quickly and easily.

Another object of this invention is to provide a portable stacking and nesting toilet which when assembled assumes a safe strong supporting structure for the user.

Another object of this invention is to provide a portable stacking and nesting toilet having an integral storage compartment for containing necessary articles.

A further object of this invention is to provide a portable stacking and nesting toilet which will fit inside a small bag whereby it may be conveniently attached to strollers, handlebars, and the like, and will fit inside other item that a person may have to carry, such as a diaper bag, suitcase, or knapsack.

A still further object of this invention is to provide a portable stacking and nesting toilet which is attractive in appearance, simple in design and construction, economical to manufacture, and rugged and durable in use.

Other objects of the invention will become apparent from time to time throughout the specification and claims as hereinafter related.

The above noted objects and other objects of the invention are accomplished by a portable stacking and nesting toilet comprising a larger and smaller cup-shaped member, a seat member having a central opening, and a resilient sealing lid. The smaller cup will nest inside the larger and the lower portion of the larger cup fits inside the opening of the seat member in an upright stored position. The bottom of each cup has a circular lip which will engage the lip of the other member. The open top ends of the cup members are provided with a rounded rim. The seat member has a groove which engages the rim of the larger cup. When assembled for use, the smaller cup is removed from the larger and inverted with the resilient lid installed on the rim of the smaller cup. The larger cup is installed upright on the inverted smaller one to engage the opposed lips. The resilient lid serves as a non-skid base for the assembled structure. A watertight sealable plastic bag is placed in the upright larger cup and the open end of the bag folded over its rim. The seat is placed on the rim of the larger cup to secure the top of the bag between the cup rim and seat groove and the toilet is ready for use.

After use, the seat is removed and the bag is disposed of. The seat is placed horizontally, the larger cup is removed from the smaller one and placed inside the seat opening, the smaller cup is placed upright inside the larger one, and the resilient lid is placed on the rim of the smaller cup. If there is no convenient location for disposing of the bag, it may be placed inside the smaller cup and sealed with the lid.

BRIEF DESCRIPTION OF THE DRAWINGS

FIG. 1 is an exploded isometric view of the components of the portable stacking and nesting toilet in a disassembled condition.

FIG. 2 is a longitudinal cross section of the components of the portable toilet in the nested position.

FIG. 5 is a perspective view of a carrying bag for the portable toilet of the present invention.

DESCRIPTION OF THE PREFERRED EMBODIMENT

Figure 4:
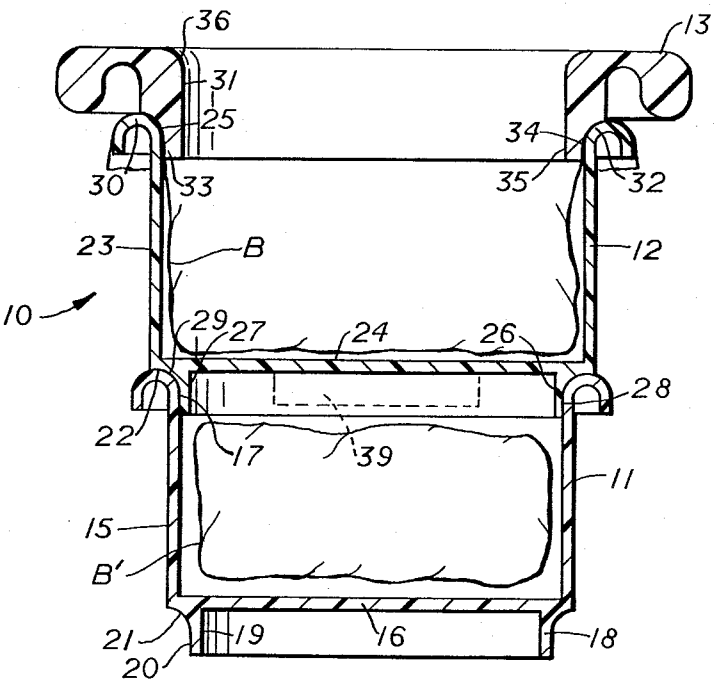
FIG. 4 is a longitudinal cross section of the components of the portable toilet in another stacked position ready for use.

Referring to the drawings by numerals of reference, there is shown in FIG. 1, the components of a preferred portable stacking and nesting toilet 10 in a disassembled condition. The toilet according to the present invention comprises a first or smaller cup-shaped member a second or larger cup-shaped member 12, a seat member 13, and may include a cover or lid member 14. The cup-shaped members will be hereinafter referred to as smaller cup 11 and larger cup 12.

Figure 3:
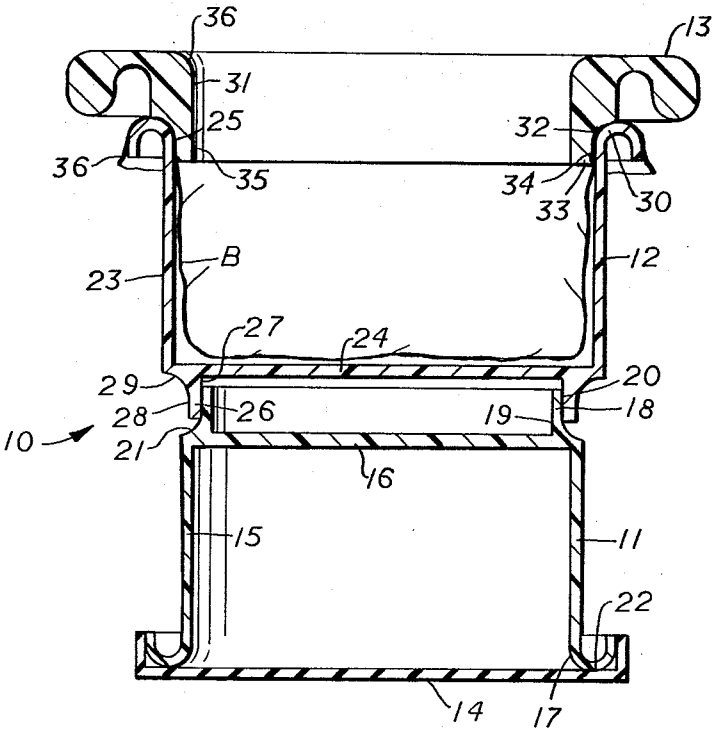
FIG. 3 is a longitudinal cross section of the components of the portable toilet in the stacked position ready for use.

Referring additionally to FIGS. 2, 3, and 4, the smaller cup 11 is a generally conical cup-shaped member having a sidewall 15, an integral bottom wall 16 at one end and an opposed open end 17. A circular raised lip 18 extends a short distance beyond the bottom wall 16 in axial alignment with the longitudinal cup axis to define an inner surface 19 and an outer surface 20 of predetermined diameter. The raised lip 18 is spaced radially inward of the lower portion of the sidewall 15 to define an annular curved shoulder 21 at the juncture of the lip with the sidewall. The open end 17 of the cup 11 is provided with an outwardly and downwarly annular curved top edge or rim 22 which has a predetermined radius of curvature.

The larger cup 12 is a generally conical cup-shaped member having a sidewall 23, an integral bottom wall 24 at one end and an opposed open end 25. A circular raised lip 26 extends a short distance beyond the bottom wall 24 in axial alignment with the longitudinal cup axis to define an inner surface 27 and an outer surface 28 of predetermined diameter. The raised lip 26 is spaced radially inward of the lower portion of the sidewall 23 to define an annular curved shoulder 29 at the juncture of the lip with the sidewall. The open end 25 of the cup 12 is provided with an outwardly and downwarly annular curved top edge or rim 30 having a predetermined radius of curvature.

The illustrated embodiment shows the sidewall of the cup members extending angularly upward and outwardly from the bottom wall in a generally conical configuration, but it should be understood that other configurations may be incorporated without departing from the scope of the invention. For example, the sidewalls of the cups may be generally cylindrical or curve upward and outwardly from the bottom wall in a bowl-like configuration to providing stability and support requirements for users of different size and weight categories. Also, the curved surfaces of the shoulders and curved top edge of the cup members could be replaced with mating straight or angular surfaces which would provide a supportive engaging relationship between the members.

The interior depth and diameter of the sidewall 23 of the larger cup 12 is greater than the length and exterior diameter of sidewall 15 of the smaller cup 11 such that the smaller cup 11 may be slidably received in a nested condition substantially within the larger cup 12 with the raised lip 18 of the smaller cup resting on the bottom wall 24 of the larger cup and the rim 22 of the smaller cup above the top of the rim 30 of the larger cup.

The diameters of the raised lips 18 and 26, the radius of curvature of the curved shoulders 21 and 29 and rims 22 and 30 is predetermined such that one cup will cooperatively engage the other cup as will be explained hereinafter.

As best seen in FIG. 3, the interior surface 27 of the raised lip 26 of the larger cup 12 is slightly greater in diameter than the diameter of the exterior surface 2 of the smaller cup 11. As illustrated, when the cups 11 and 12 are placed end to end, the lip 18 of the smaller cup 11 is slidably received within the lip 26 of the larger cup 12. In this position, the cups 11 and 12 are releasably engaged in a stacked opposed supportive position.

As best seen in FIG. 4, when the bottom of the larger cup 12 is placed on the open end of the smaller cup 11, the exterior surface 28 of the raised lip 26 is slidably received within the open end 17 of the smaller cup 11. The radius of curvature of the curved shoulder 29 of the larger cup 12 is slightly greater than the radius of curvature of the rim 22 of the smaller cup 11. In this position, the cups 11 and 12 are releasably engaged in a stacked upright supportive position.

The seat member 13 is a generally elliptical member having an elliptical opening 31 therethrough. A concave groove 32 encircles the elliptical opening 31 on the underside of the seat 13. The inside diameter of the groove 32 and the vertical seat thickness around the opening 31 define a depending lip 33 which has a coaxial cylindrical outer surface 34 and an elliptical inner surface 35. In other words, the wall thickness of the lip 33 is greater at the minor axis of the elliptical opening 31 than at the major axis.

As shown in FIG. 2, the top edge of the seat opening 31 is curved at 36 and the radius of curvature is slightly less than the radius of the curved shoulder 29 of the larger cup 12. When the bottom of the larger cup 12 is placed on the opening 31 of the seat 13, the exterior surface 28 of the raised lip 26 of the larger cup 12 is slidably received within the elliptical opening 31 of the seat 13. In this position, the larger cup is releasably engaged in a stacked upright position on the seat 13.

As shown in FIGS. 3 and 4, the diameter and radius of curvature of the seat groove 32 is such that when the seat 13 is placed on the rim 30 of the larger cup 12, the cylindrical outer surface of the depending lip 33 is slidably received within the open end 25 of the larger cup 12. The radius of curvature of the groove 32 is slightly greater than the radius of curvature of the rim 30 of the larger cup 12. In this position, the seat 13 is releasably engaged and supported on the open end 25 of the larger cup 12.

A waterproof bag B may be placed inside the larger cup 12 and its open end folded over the rim 30 of the larger cup 12. When the seat 13 is placed on the open end of the cup 12, the top portion of the bag B is captured between the curved surfaces of the rim 30 and the groove 32 on the underside of the seat 13 (FIG. 3). Commercially available plastic bags which are provided with strong watertight sealing means are suitable for use with the toilet. It should be noted that the toilet could also be used without the disposable bags.

A circular cover or closure lid 14 of suitable resilient material has a flat surface 37 and a circumferential raised lip 38. The interior diameter and profile configuration of the lip 38 is sufficient to allow the lid 14 to be removably received on the rim 22 of the smaller cup in a watertight sealing engagement. The lip illustrated is straight in cross section, but may also be provided with an annular bead which would engage the underside of the rim 22 to prevent accidental removal. The resilient lid 14 when installed on the rim 22 of the smaller cup 11, with the cup in the inverted position shown in FIG. 3, provides the stacked cups with a non-skid base. When installed on the rim of the smaller cup 11, with the cups in the nested position shown in FIG. 2, the lid 14 provides a watertight closure for the smaller cup allowing it to be used for a storage container for unused bags or other articles or for temporarily storing a filled bag.

As shown in dotted line in FIGS. 2 and 4, a disc-shaped deoderizer element 39 may be secured to the bottom of either of the cups 11 or 12 within their raised lip, or to the underside of the resilient lid 14 (not shown), to mask undesirable odors. Suitable deoderizer elements are readily available which are provided with "peel and stick" attachment means.

FIG. 5 shows a carrying bag 40 for transporting the portable toilet of the present invention. The carrying bag 40 is in the style of a pouch or very small laundry bag having a drawstring top closure arrangement. The carrying bag 40 allows the enclosed toilet in the compact nested position to be easily and conveniently attached to strollers, handlebars, and the like, by simply tying the drawstring around whatever object is convenient. The nested toilet assembly is preferrably small enough to fit inside other articles that a person may have to carry, such as a diaper bag, suitcase, or knapsack.

The cup members 11 and 12 and the seat member 13 are preferrably molded of strong durable plastic suitable for washing and sterilization. The components of the toilet may be made in sizes for use by small children or in a larger size for use by adults when camping or traveling. In the preferred form, The nested height of the assembly would only be slightly taller than the larger cup. When stacked for use, the height would be about twice the height of the larger cup.

Using the smaller cup as the base, allows room beneath the seat for the user's feet in a sitting position. However, the toilet may also be designed to use the larger cup as the base wherein the seat groove would be received on the rim of the smaller cup and the lid would seal on the larger cup.

OPERATION

The portable toilet is conveniently carried in the nested position and is easily and quickly assembled in the stacked position for use.

FIG. 2 shows the toilet assembled in the stored or nested position. The seat is placed horizontally and the larger cup 12 is placed upright on top of the seat with the cup lip 26 inside of the elliptical opening 31 of the seat 13. In this position, the larger cup is releasably engaged in a stacked upright position on the seat.

The smaller cup 11 is slidably received inside the larger cup 12 in the upright position in a nested condition with the raised lip 18 of the smaller cup resting on the bottom wall 24 of the larger cup 12, and the rim 22 of the smaller cup 11 above the top of the rim 30 of the larger cup.

The resilient lid 14 is installed on the rim 22 of the smaller cup 11 to provide a watertight closure for the smaller cup allowing it to be used for a storage container. A supply of plastic bags, toilet tissue, or other items may be stored in the cup interior to conserve space and to keep necessary items close at hand.

FIG. 3 shows the toilet in the stacked position ready for use. The smaller cup 11 is removed from the larger cup 12 and inverted with the resilient lid 14 installed over the open end of the smaller cup. In this position, the interior of the smaller cup 11 may still be used for storage. The larger cup 12 is placed upright on top of the inverted smaller cup 11. The interior surface 27 of the raised lip 26 of the larger cup 12 is slightly greater in diameter than the diameter of the exterior surface 20 of the lip 18 of the smaller cup 11 and the lip of the smaller cup is slidably received within the lip of the larger cup.

A waterproof bag 36 is placed inside the larger cup 12 and its open end is folded over the rim 30 of the larger cup. The seat 13 is then placed on the rim 30 of the larger cup 12 to capture the top portion of the bag 36 between the curved surfaces of the rim 30 of the larger cup and the groove 32 on the underside of the seat 13. The toilet is now ready for use. In this position, the cups are rigidly connected in a stacked opposed relation, the bag is secured in place, and the resilient lid 14 provides a non-skid base for the assembled structure.

FIG. 4 shows the toilet in another possible stacked position ready for use. In this position, the smaller cup 11 is removed from the larger cup 12 and placed upright. The cup 11 may or may not be placed on the resilient lid. In this position, the interior of the smaller cup 11 may be used for storage of bags B or other items. The larger cup 12 is placed upright on top of the upright smaller cup 11. When the bottom of the larger cup 12 is placed on the open end of the smaller cup 11, the exterior surface of the raised lip 26 is slidably received within the open end of the smaller cup 11. The radius of curvature of the curved shoulder 29 of the larger cup 12 is slightly greater than the radius of curvature of the rim 22 of the smaller cup 11.

A waterproof bag B is placed inside the larger cup 12 and its open end is folded over the rim 30 of the larger cup. The seat 13 is then placed on the rim 30 of the cup 12 to capture the top portion of the bag B between the curved surfaces of the rim 30 of the larger cup and the groove 32 on the underside of the seat 13. The toilet is now ready for use. In this position, the cups are rigidly connected in a stacked upright position, the bag is secured in place, and the resilient lid 14, if used, provides a non-skid base for the assembly.

After use, the plastic bag containing the waste is sealed and may be conveniently disposed of. .The toilet may then be disassembled and again placed in the stored or nested position within the carrying bag 40. The seat 13 is placed horizontally at the bottom of the bag 40 and the larger cup 12 is placed upright on top of the seat with the cup lip 26 inside of the elliptical opening of the seat.

The smaller cup 11 is placed inside the larger cup in the upright position in a nested condition with the raised lip of the smaller cup resting on the bottom wall of the larger cup and the rim of the smaller cup above the top of the rim of the larger cup. If there is no convenient location for disposing of the bag containing the waste, it may be placed inside the smaller cup.

The resilient lid 14 is installed on the rim of the smaller cup to provides a watertight closure for the smaller cup allowing it to be used for a temporary storage container for the used bag. A supply of plastic bags, toilet tissue, or other items may also be stored in the carrying bag.

While this invention has been described fully and completely with special emphasis upon a preferred embodiment, it should be understood that within the scope of the appended claims the invention may be practiced otherwise than as specifically described herein.

We claim:

1. A portable stacking and nesting toilet comprising;

a first or smaller cup-shaped member having a bottom wall and an integral sidewall extending upwardly therefrom which terminates in an open top end, a second or larger cup-shaped member having a bottom wall and an integral sidewall extending upwardly therefrom which terminates in an open top end, and said first or smaller cup-shaped member sufficiently smaller than the second or larger cup-shaped member to be slidably received substantially therein in an upright nested position.

the bottom portions of said smaller cup-shaped member and said larger cup-shaped member each configured to releasably engage one another when placed end to end in an opposed stacked position, the bottom portion of said larger cup-shaped member configured to releasably engage the open top end of said smaller cup-shaped member when placed thereon in an upright stacked position, and a seat member having its underside configured to releasably engage the open top end of the uppermost cup-shaped member of the stacked cup-shaped members when placed thereon and having a central opening therethrough smaller than the open top end of the uppermost member and said seat member configured to receive the bottom portion of said larger cup-shaped member in the nested position.

2. The portable stacking and nesting toilet according to claim 1 including a waterproof bag member of sufficient size to be placed inside the uppermost cup-shaped member of the stacked cup-shaped members with its open end folded over the open top end of said uppermost cup-shaped member and releasably held thereon when said seat member is placed on the open end of same said cup-shaped member.

3. The portable stacking and nesting toilet according to claim 1 including at least one circular cover member formed of resilient material having a flat surface and a peripheral raised lip configured to releasably engage the open end of said cup-shaped members in a watertight sealing engagement.

4. The portable stacking and nesting toilet according to claim 3 in which said cover member when installed on the open end of said lowermost cup-shaped member in the opposed stacked position providing a non-skid base and when installed on the open end of said smaller cup-shaped member with the cups in the nested position providing a watertight closure therefor allowing it to be used for a storage container.

5. The portable stacking and nesting toilet according to claim 3 including a deoderizer element capable of being releasably secured to said cover member to mask undesirable odors.

6. The portable stacking and nesting toilet according to claim 1 including a deoderizer element capable of being releasably secured to said cup-shaped members to mask undesirable odors.

7. The portable stacking and nesting toilet according to claim 6 in which said deoderizer element provided with adhesive attachment means for releasably securing it to said cup shaped members.

8. The portable stacking and nesting toilet according to claim 1 including a carrying bag for transporting the portable toilet in the nested position and having attachment means for releasably attaching the bag to other objects.

9. The portable stacking and nesting toilet according to claim 8 in which said bag attachment means comprises a drawstring top closure arrangement.

10. The portable stacking and nesting toilet according to claim 1 including a waterproof bag member of sufficient size to be placed inside the uppermost cup-shaped member of the stacked cup-shaped members with its open end folded over the open top end of said uppermost cup-shaped member and releasably held thereon when said seat member is placed on the open end of same said cup-shaped member, at least one circular cover member formed of resilient material having a flat surface and a peripheral raised lip configured to releasably engage the open end of said cup-shaped members in a watertight sealing engagement, said cover member when installed on the open end of said lowermost cup-shaped member in the opposed stacked position providing a non-skid base and when installed on the open end of said smaller cup-shaped member with the cups in the nested position providing a watertight closure therefor allowing it to be used for a storage container, a deoderizer element capable of being selectively releasably secured to said cup-shaped members and said cover member to mask undesirable odors, and a carrying bag for transporting the portable toilet in the nested position and having attachment means for releasably attaching the bag to other objects.

11. The portable stacking and nesting toilet according to claim 1 in which said seat member having its underside configured to releasably engage the open top end of said larger cup-shaped member and having a central opening therethrough, said opening being smaller than the open top end of said larger cup-shaped member and larger than the bottom portion of said larger cup-shaped member to slidably receive the bottom portion therein.

12. The portable stacking and nesting toilet according to claim 1 in which the bottom portions of said smaller and said larger cup-shaped members each have a cylindrical raised lip extending a short distance beyond their bottom wall in axial alignment with the longitudinal cup axis and spaced radially inward from the sidewall to define an annular shoulder on the sidewall lower portion, the raised lip of said smaller cup-shaped member of sufficient size to be slidably received within the inner diameter of the raised lip of said larger cup-shaped member to releasably engage said cup-shaped members with one another when placed end to end in an opposed stacked position, and the raised lip of said larger cup-shaped member of sufficient size to be slidably received on the open top end of said smaller cup-shaped member when placed thereon in an upright stacked position to releasably engage the open top end of said smaller cup-shaped member therewith.

13. The portable stacking and nesting toilet according to claim 12 in which the annular shoulder on the bottom portion of said smaller and larger cup-shaped members each has an inwardly curved radius at the juncture of said lip with the sidewall.

14. The portable stacking and nesting toilet according to claim 12 in which the circumferential edge of the open end of each said smaller and larger cup-shaped members is an outwardly rounded annular rim.

15. The portable stacking and nesting toilet according to claim 12 in which the annular shoulder on the bottom portion of said smaller and said larger cup-shaped members each has an inwardly curved radius at the juncture of said lip with the sidewall, the circumferential edge of the open end of each said smaller and larger cup-shaped members is an outwardly rounded annular rim, the inwardly curved radius of said smaller cup-shaped member being of sufficient size to engage the outwardly rounded annular rim of said larger cup-shaped member when placed thereon in an upright stacked position, and the underside of said seat member having an inwardly curved shoulder to releasably engage the outwardly rounded annular rim of said larger cup-shaped member when placed thereon.

16. The portable stacking and nesting toilet according to claim 15 in which the interior depth and diameter of the sidewall of the larger cup-shaped member is greater than the length and exterior diameter of the smaller cup-shaped member such that the smaller cup-shaped member may be slidably received in a nested condition within the larger cup-shaped member with the raised lip of the smaller cup-shaped member resting on the bottom wall of the larger cup-shaped member and the annular rim of the smaller cup just above the top of the rim of the larger cup-shaped member.

17. The portable stacking and nesting toilet according to claim 15 in which the top of the opening of said seat member is curved corresponding to the radius of the curved portion of the shoulder of said larger cup-shaped member such that when the bottom portion of said larger cup-shaped member is placed on the seat opening, the raised lip of the larger cup-shaped member is slidably received within the opening and the larger cup-shaped member is releasably engaged in an upright position on the seat.

18. The portable stacking and nesting toilet according to claim 1 in which the height of the nested cup-shaped members being slightly greater than the height of said larger cup-shaped member and the height of said cup-shaped members in the stacked position for use being approximately twice the height of said larger cup.

* * * * *